United States Patent [19]

Hall et al.

[11] 4,163,628

[45] Aug. 7, 1979

[54] IMPLEMENT CIRCUIT FOR MOTOR WITH SLOW AND FAST DUMP

[75] Inventors: Gerald D. Hall, Joliet; Lloyd D. Swayze, Yorkville, both of Ill.

[73] Assignee: Caterpillar Tractor Co., Peoria, Ill.

[21] Appl. No.: 795,036

[22] Filed: May 9, 1977

[51] Int. Cl.[2] ..... E02F 3/87

[52] U.S. Cl. ..... 414/699; 60/486

[58] Field of Search ..... 214/140, 762, 763, 764; 91/27, 414; 60/486

[56] References Cited

U.S. PATENT DOCUMENTS

| | | | |
|---|---|---|---|
| 3,614,273 | 10/1971 | Wallace | 214/762 X |
| 3,646,596 | 2/1972 | Bauer | 60/486 X |
| 3,916,767 | 11/1975 | Barton | 214/762 X |

*Primary Examiner*—L. J. Paperner

*Attorney, Agent, or Firm*—Phillips, Moore, Weissenberger, Lempio & Majestic

[57] ABSTRACT

A loader vehicle includes a loading implement movable to a dump and a rack-back position by means of actuation of cylinders. The movement of the cylinders is provided by fluid control valves in turn operated by means which provide for both a slow dump and a fast dump movement of the implement, with fast dump movement initially selected being automatically changed to slow dump movement dependent on the position of the implement.

7 Claims, 7 Drawing Figures

300
302
20'
142'
312
312'
44'
314
138'
20'
176'
46'
180'
134'
194'
188'
200'
130'
132'
16'
16'
198'
186'
128'
179'
174'
136'
170'
38'
36'
70'
140'
214
204'
216
206'
192'
177'
112
318
202'
32'
40'
310
168"
190'
175'
308
208'
212'
182'
154'
306
166'
178'
158'
154'
34'
28'
30'
304
316
172'
156
168'
210'
196'
152
26'
184'
220'

IMPLEMENT CIRCUIT FOR MOTOR WITH SLOW AND FAST DUMP

BACKGROUND OF THE INVENTION

This invention relates to a vehicle including a loading implement, and more particularly, to a vehicle incorporating a bucket which may be moved in a slow dump and a fast dump mode.

U.S. Patent Application No. 775,062, entitled "HIGH PRESSURE IMPLEMENT CIRCUIT FOR LOADER WITH SLOW AND FAST DUMP POSITION", filed Mar. 7, 1977 (assigned to the assignee of this invention), discloses a system for use with a vehicle including an implement movable to a rack-back and a dump position. As disclosed therein, the operator of the vehicle may select a relatively high speed of movement from the rack-back to the dump position, or a relatively low speed of movement thereof. In such system, it will be seen that once a certain dump mode is chosen, that dump mode will remain in effect until the operator of the vehicle selects a different dump mode. In order to add to the overall flexibility of operation of the apparatus, it would be useful to provide means wherein, upon selection of the fast-dump mode with the implement in the rack-back position, the implement automatically moves to the slow-dump mode after a certain amount of movement thereof, to provide highly effective control of the load carried by the implement.

SUMMARY OF THE INVENTION

The present invention is directed to overcoming one or more of the problems as set forth above.

Broadly stated, the invention is in a vehicle having tilt cylinder means actuated in one and the other direction to move a bucket to a dump position and to a rack-back position respectively. The invention comprises a hydraulic control system comprising fluid pump means, and means operatively interconnecting the fluid pump means and tilt cylinder means (i) for selectively providing a first, relatively lower speed of movement of the bucket from the rack-back position toward the dump position through actuation of the tilt cylinder means, and for selectively providing a second, relatively higher speed of movement of the bucket from the rack-back position toward the dump position through the actuation of the tilt cylinder means, the means operatively interconnecting the fluid pump means and tilt culinder means (ii) further providing that upon initial selection of the second, relatively higher speed of movement of the bucket from the rack-back position toward the dump position, and upon a degree of said higher speed movement taking place, the first, relatively lower speed of movement of the bucket from the rack-back position toward the dump position is automatically chosen.

BRIEF DESCRIPTION OF THE DRAWINGS

Other objects of the invention will become apparent from a study of the following specification and drawings, in which.

DESCRIPTION OF FIGS. 1, 2, 3, 4 and 5

Figure 1:
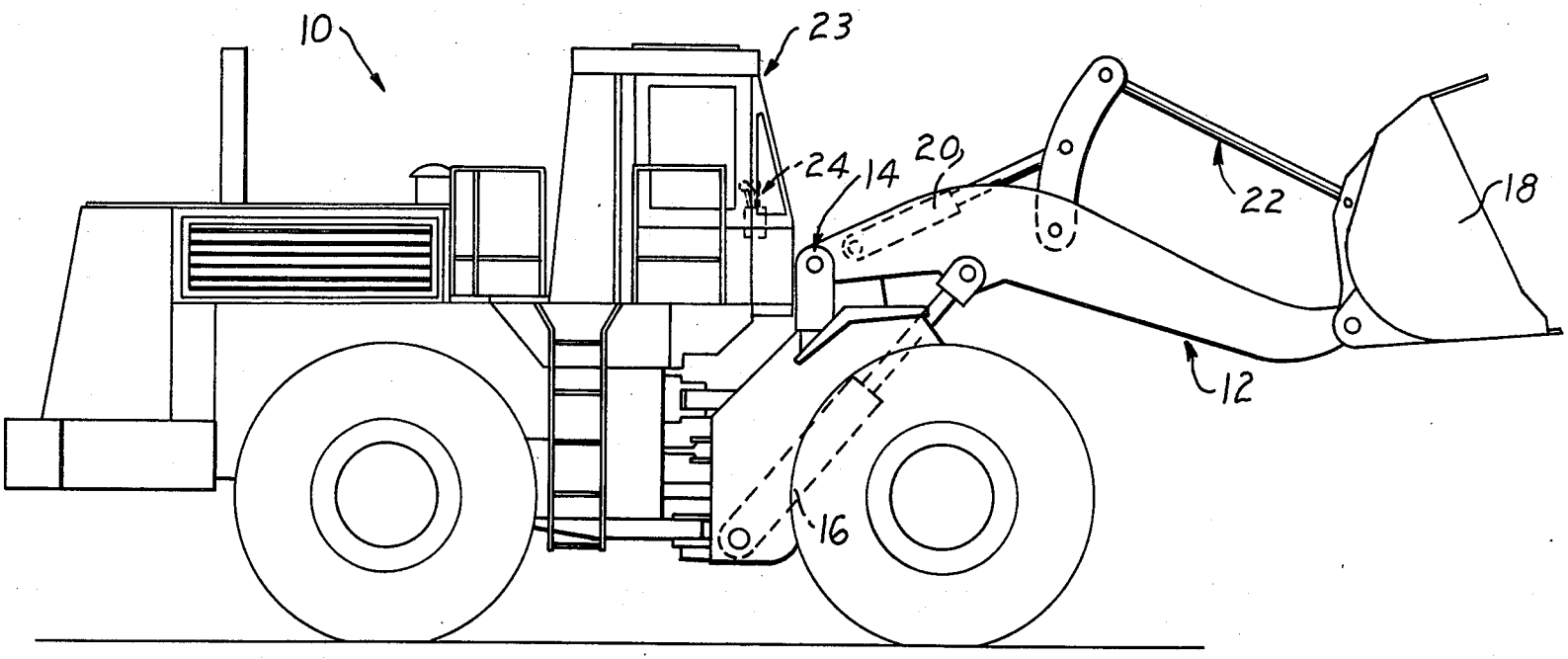
FIG. 1 is a side elevation of a vehicle into which the present invention is incorporated.

Shown in FIG. 1 is a vehicle 10 including lift arms 12 forwardly disposed thereof, pivotally attached to the frame 14 of the vehicle 10, and raisable and lowerable by extension and retraction of lift cylinders (one shown at 16). Pivotally secured to the extended ends of the lift arms 12 is a bucket 18 which may be pivoted in one and the other directions by extension and retraction of tilt cylinders (one shown at 20) operating through a tilt linkage 22, as is well known. It will be seen that extension of these cylinders 20 moves the bucket 18 to a dump position, and retraction of the cylinders 20 moves the bucket 18 to a rack-back position.

Figure 2:
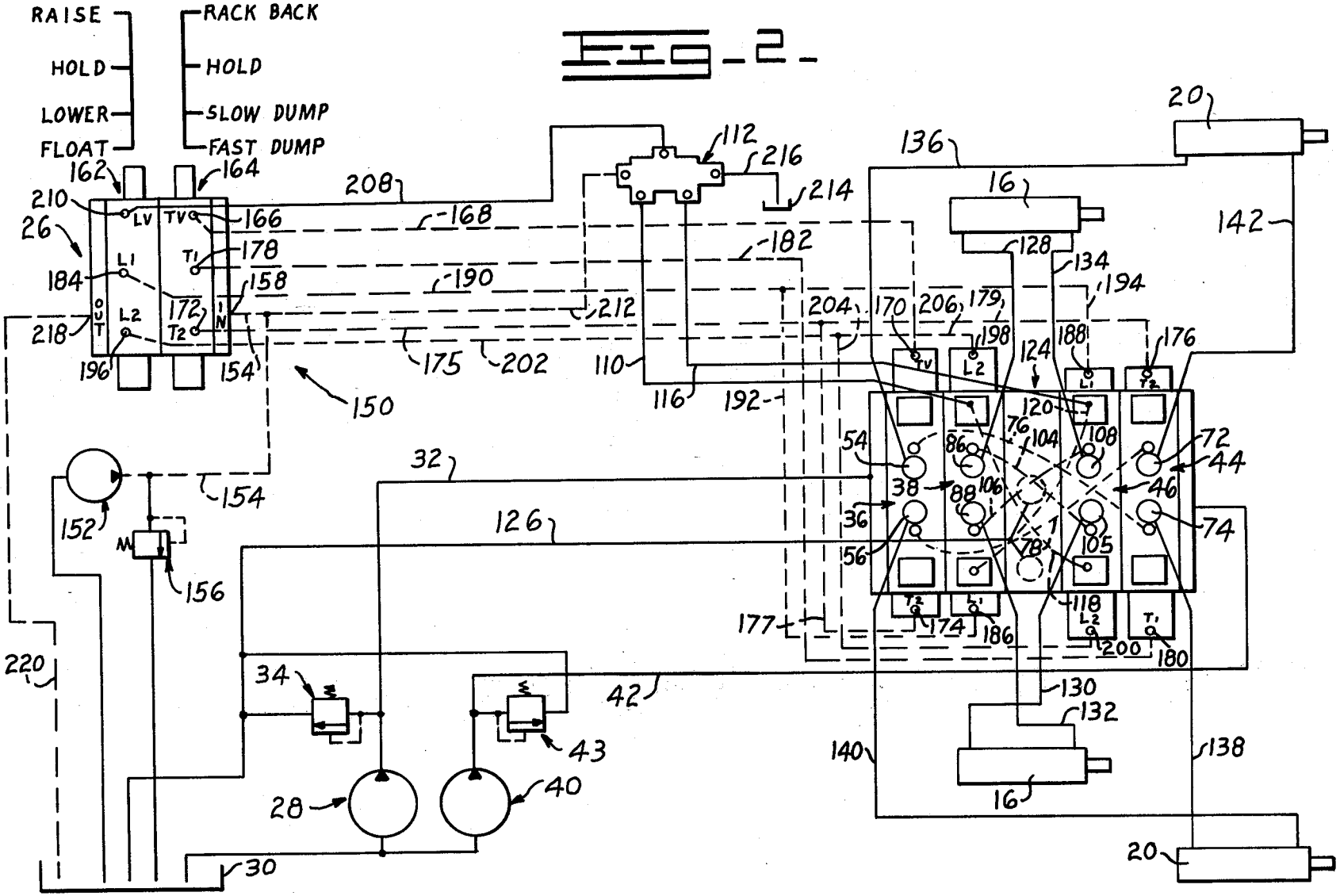
FIG. 2 is a generally schematic representation, with parts in section, of a hydraulic control circuit into which the invention is incorporated.
Figure 3:
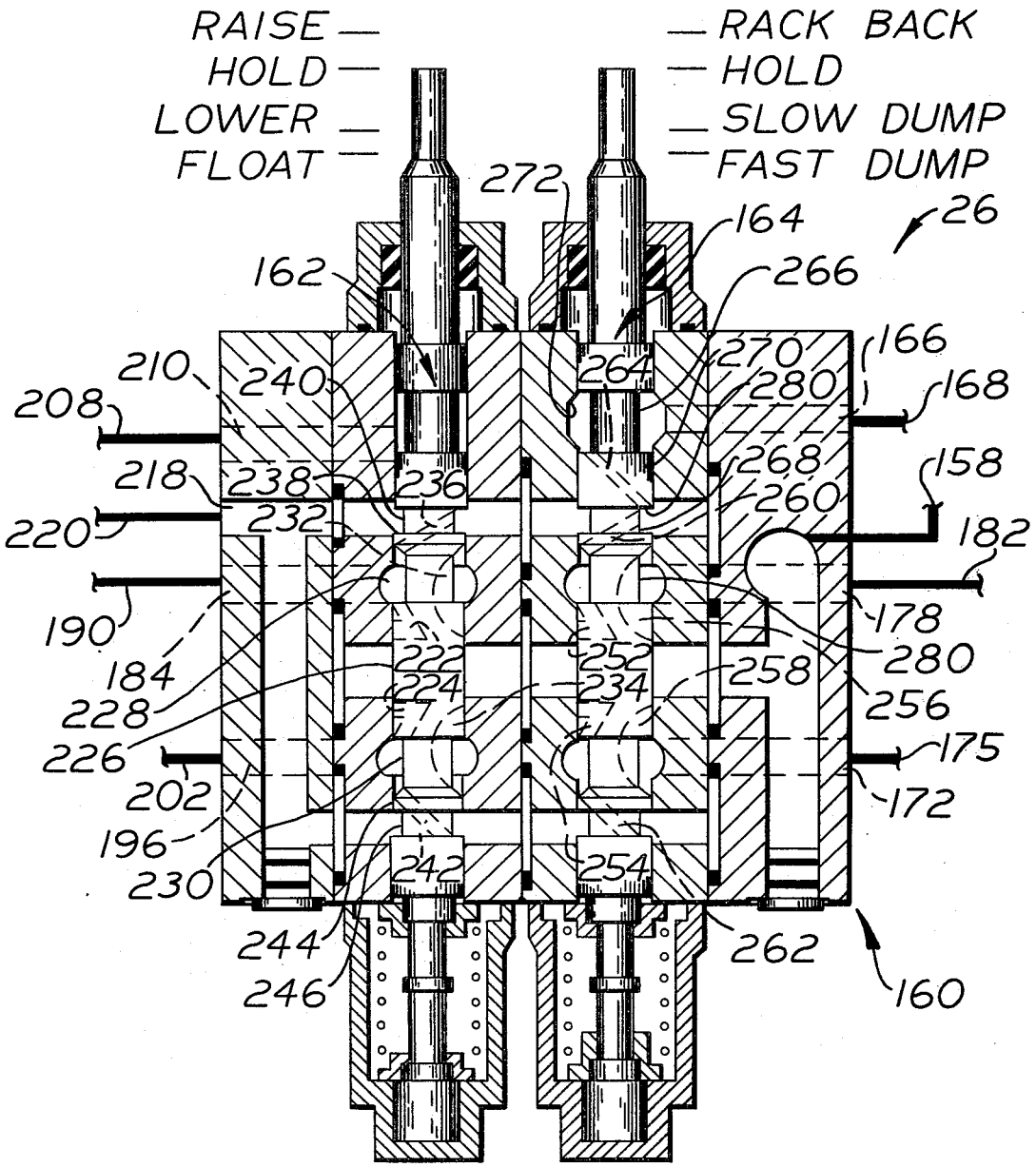
FIG. 3 is a fragmentary view, with parts in section, of a portion of the control circuit of FIG. 2.

The vehicle 10 includes an operator's station 23, with operator controls 24 for selectively actuating the lift and tilt cylinders 16, 20. The operator controls 24 include actuator valve means 26 as shown in FIGS. 2 and 3, readily accessible to the operator of the vehicle 10, the construction and operation of which will be described in detail further on.

A first fixed displacement implement fluid pump 28 draws fluid from a reservoir 30 through a conduit 32, past a main relief valve 34, and to a pair of control valves 36, 38. A second fixed displacement implement fluid pump 40 draws fluid from reservoir 30 through a conduit 42 past a main relief valve 43 to a second pair of control valves 44, 46.

The control valve 36 (FIG. 4) has an inlet port 48 for receiving fluid from the conduit 32. The inlet port 48 is in communication with a branched supply conduit 50 by means of an inlet check valve 52. The valve 36 also includes a pair of service ports or chambers 54, 56 spaced apart on opposite sides of branched conduit 50 with drain ports 58, 60 being arranged respectively adjacent the service ports 54, 56. A valve spool 62 is slidably arranged within a bore 64 to selectively regulate communication of the service ports 54, 56 with either the branched supply conduit 50 or the drain ports 58, 60. The valve spool 62 is shown in a neutral position under the influence of a centering spring mechanism 66 where both the service chambers 54, 56 are blocked from communication with either the supply conduit 50 or the drain ports 58, 60. Makeup valves 68, 70 respectively provide communication between the service ports 54, 56 and the drain ports 58, 60 whenever fluid pressure in one of the service ports is less than the fluid pressure in the drain passages.

The control valve 36 is operatively associated with the control valve 44, which control valves 36, 44 are similar in construction to the valve disclosed in U.S. Pat. No. 3,847,059 (assigned to the assignee of this invention), which Patent is incorporated by reference herein. The control valve 44 also, of course, includes service ports 72, 74, generally shown in FIG. 2. In accordance with the disclosure of U.S. Pat. No. 3,847,059, an equalizing conduit 78 communicates between the service ports 56, 72, while a similar equalizing conduit 76 communicates the service ports 54, 74. These conduits 76, 78 assure equal pressure to the head ends and rod ends respectively of the cylinders 20, in accordance with such U.S. Pat. No. 3,847,059, as will be further discussed.

Figure 5:
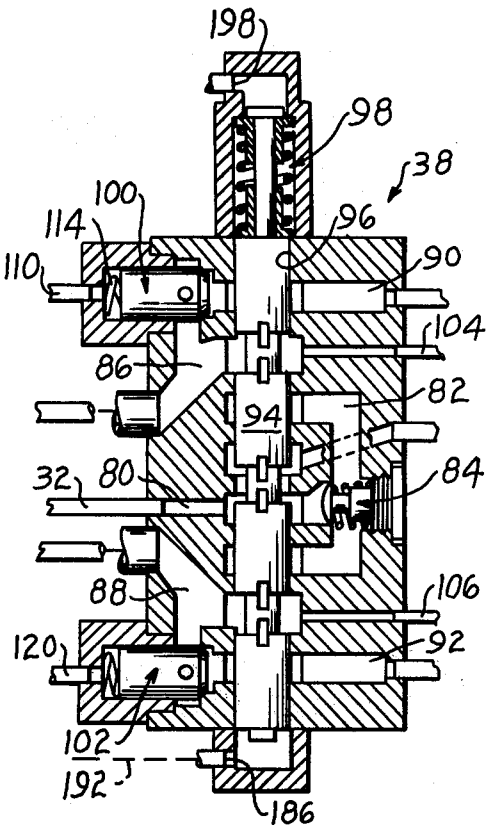
FIG. 5 is a fragmentary view, with parts in section, of yet another part of the control circuit of FIG. 2.
Figure 4:
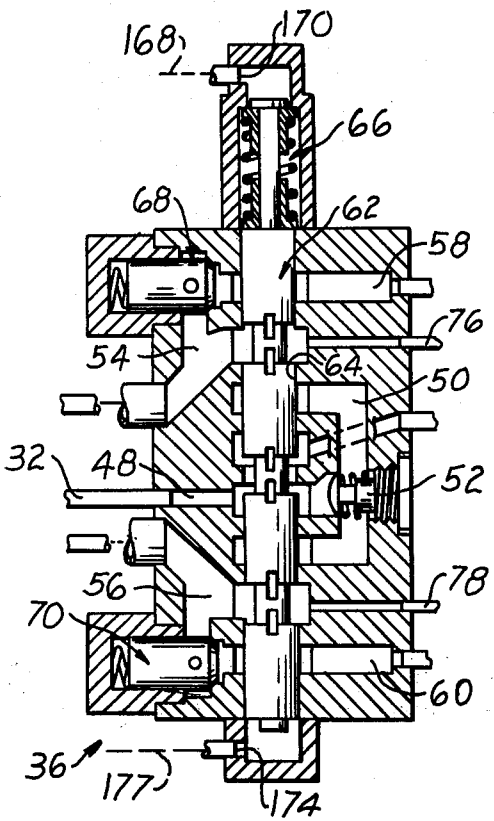
FIG. 4 is a fragmentary view, with parts in section, of another portion of the control circuit of FIG. 2.

Shown in FIG. 5 is the control valve 38. As shown therein, and similar to the control valve 36, the control valve 38 has an inlet port 80 for receiving fluid from the conduit 32. The inlet port 80 is in communication with a branched supply conduit 82 by means of an inlet check valve 84. The valve 38 also includes a pair of service ports or chambers 86, 88 spaced apart on opposite sides of branched conduit 82 with drain ports 90, 92 being arranged respectively adjacent the service ports 86, 88. A valve spool 94 is slidably arranged within a bore 96 to selectively regulate communication of the service ports 86, 88 with either the branched supply conduit 82 or the drain ports 90, 92. The valve spool 94 is shown in a neutral position under the influence of a centering spring mechanism 98 where both of the service chambers 86, 88 are blocked from communication with either the supply conduit 32 or the drain ports 90, 92. Makeup valves 100, 102 respectively provide communication between the service ports 86, 88 and the drain ports 90, 92, whenever fluid pressure in one of the service ports 86, 88 is less than the fluid pressure in the drain passages. Similar to the above description, the control valve 46 is generally identical to the control valve 38, and the control valves 38, 46 are paired in a manner as disclosed in U.S. Pat. No. 3,847,059. Equalizing conduit 104 provides communication between the service ports 86, 105 of the respective control valves 38, 46.

A conduit 110 communicates a three-way vent valve 112 with the back chamber 114 of the valve 100, and a conduit 116 communicates the valve 112 with a back chamber of a makeup valve in control valve 46. A cross-conduit 118 provides communication between the back chamber 110 of control valve 38 and the corresponding back chamber of control valve 46. A cross-conduit 120 provides communication between the back chamber 122 of control valve 38 and the corresponding back chamber of control valve 46. The center portion 124 of the entire control valve assembly 36, 38, 44, 46 is a common drain manifold which communicates with tank 30 through a conduit 126, again generally similar to the apparatus disclosed in U.S. Pat. No. 3,847,059. Each of the drain conduits of the individual control valves 36, 38, 44, 46 communicates with this manifold 124.

As shown in FIG. 2, the service ports 86, 105 communicate with the head ends of the lift cylinders 16 through conduits 128, 130, and the service ports 88, 108 communicate with the rod ends of the lift cylinders 16 through conduits 132, 134. The service ports 54, 74 communicate with the head ends of the tilt cylinders 20 through conduits 136, 138, and the service ports 56, 72 communicate with the rod ends of the tilt cylinders 20 through conduits 140, 142.

A pilot pressure system 150 includs a pilot pump 152 which communicates through a conduit 154 to the actuator valve 26 shown in FIG. 3. Such conduit 154 feeds over a pilot pressure relief valve 156 or to a pilot supply pressure port 158. Valve body 160 (FIG. 3) of actuation valve means 26 has first and second valve spools 162, 164 reciprocable therein. The valve body 160 also includes a port 166 communicating with one end 170 of the control valve 36 through a conduit 168, and a port 172 which communicates with the opposite end 174 of the control valve 36 and also the end 176 of the control valve 44 through conduit 175 and branch conduits 177, 179. The valve body 160 further defines a port 178 which communicates with the opposite end 180 of the control valve 44 through a conduit 182.

The actuator valve body 160 also defines a port 184 which communicates with the end 186 of the control valve 38, and the end 188 of the control valve 46, through conduit 190 and branch conduits 192, 194. The body 160 defines a port 196 which communicates with the end 198 of the control valve 38 and the end 200 of the control valve 46, through a conduit 202 and branch conduits 204, 206. A conduit 208 interconnects a port 210 of the body 160 and the valve 112, and pilot pressure is supplied to the valve through a conduit 212. The valve 112 also communicates with tank 214 through a conduit 216.

The body 160 also defines an outlet port 218 communicating with tank 30 through a conduit 220.

The spool 162 is operatively associated with the ports 196, 184, 218, 210, and the spool 164 is operatively associated with the ports 166, 158, 178, 172. For description of operation of an actuator valve generally similar to actuator valve 26, reference is made to U.S. Pat. No. 3,869,107, assigned to the assignee of this invention, which patent is incorporated by reference herein. It is noted, however, that the present invention does not include hydraulic detents as disclosed in U.S. Pat. No. 3,869,107.

In accordance with U.S. Pat. No. 3,847,059 (incorporated by reference herein), pilot pressure applied to one or the other side of each control valve 36, 38, 44, 46, which control valves are disclosed in U.S. Pat. No. 3,847,059, will shift the spool operatively associated therewith in a manner to provide appropriate communication between certain ports for actuating the tilt and lift cylinders 20, 16.

The spool 162 and its association with the ports 196, 184, 218, 110 generally follows the construction and operation of the spools in U.S. Pat. No. 3,771,564, assigned to the assignee of this invention. As described therein, the spool 162 defines drilled passages 222, 224 and metering slots 232, 234 extending from the land 226 into the recessed portions 228, 230 respectively. An orifice 236 extends through the body of the spool 162, from one side of a land 238 to the other side thereof, communicating a recess 240 of the spool 162 with recess 228. Likewise, an orifice 242 is defined by the spool 162, and extends therethrough from one side of a land 244 to the other, communicating the recess 230 with a recess 246. The spool 162 is shown in its neutral or "hold" position, wherein pilot pressure is blocked from communication with any of the ports. It will therefore be seen that no pilot pressure is applied to either of the control valves 38, 46 within which the spool 162 is operatively associated.

Movement of the spool 162 in an upward direction to a raise position provides communication of pilot pressure with the port 196, the orifices 224, 234 providing close control and modulation of such pressure during movement of the spool 162, the orifice 242 being of small enough diameter to provide pressure buildup in the port 196 to provide pilot pressure to the conduit 202, and to the control valves 38, 46, in accordance with U.S. Pat. No. 3,771,564.

The application of pilot pressure to the control valves at ends 198 and 300 provides for shifting of the spools thereof in accordance with U.S. Pat. No. 3,847,059 to supply pressurized fluid to the head ends of the lift cylnders 16, to extend the lift cylinders 16, to in turn raise the lift arms 12 of the vehicle 10. Supply pressure to the cylinders is equalized by conduit 104. The rod ends of the lift cylinders 16 are relieved through control valves 38, 46.

Returning the spool 162 to the "hold" position, of course, again blocks off pilot pressure from any of the ports, and also provides that none of the ports communicating with the lift cylinders 16 communicates with tank, so that the lift arms 12 are held in position relative to the vehicle.

In order to lower the arms 12, the spool 162 is moved to the lower position, wherein pilot pressure is supplied to the port 184, in turn supplying pilot pressure to the control valves 38, 46 at ends 186 and 188, to retract the cylinders 16, to in turn lower the lift arms 12 of the vehicle 10. The equalizing conduit 106 assures equal pressurization in the rod ends respectively of these cylinders 16, in accordance with U.S. Pat. No. 3,847,059.

During operating conditions, the chamber 114 of the makeup valve 100 in control valve 38 and the corresponding back chamber of control valve 46 communicate with the pilot valve port 210. This is accomplished through conduits 118, 110, vent valve 112 and conduit 208. If the spool 162 is moved to the float position, the port 218 communicates with port 210 so that the pressure in the chambers behind the makeup valves is relieved allowing them to open.

The spool 164 is generally identical with the spool 162, including orifices 252, 254, 256, 258, 260, 262 corresponding to orifices 222, 224, 232, 234, 236, 242, and also another orifice 264 communicating the recessed area 266 with the recessed area 268 from one side of a land 270 to the other. Additionally, the body defines an annular chamber 272, which communicates with port 166.

The spool 164 is shown in the first or "hold" position, wherein fluid pressure is blocked from communication with any of the ports so that no pilot pressure is applied to the control valves 36, 44. Movement of the spool 164 to a rack-back position provides for communication between the port 158 and port 172, the orifice 262, of course, being sufficiently small to provide pressure buildup in the port 172, to in turn supply pilot pressure to the end 174 of the control valve 36 and the end 176 of the control valve 44, to in turn supply fluid pressure to the rod ends of the cylinders 20. Conduit 78 provides for equalization of supply pressure to the rod ends of the cylinders 20. The head ends of the cylinders 20 are communicated to tank through control valves 36, 44, so that the cylinders 20 are retracted, moving the bucket 18 to a rack-back position. The rod ends of the cylinders 20 are relieved through conduits 142, 140. If the spool is placed in the "hold" position, pilot fluid pressure is blocked from communication with the control valves 36, 44, and the bucket 18 is held in position.

If the spool 164 is moved to the second or slow dump position, fluid pressure is supplied through the orifice 252 and orifice 256 to the recess 280, and to the port 178, it being remembered that the cross-section of the orifice 260 is small enough to provide pressure buildup in the port 178. Such pressure is communicated to end 180 of the control valve 44 through conduit 182, providing movement of the spool therein to in turn direct fluid pressure to the head end of the tilt cylinder 20 shown in the lower right of FIG. 2. Such pressure is communicated from the service port 74 to the service port 54 through conduit 76, and through conduit 136 to the head end of the other tilt cylinder 20 (upper right in FIG. 2). The pressure supplied to the head ends of these cylinders is supplied only by the pump 40, the pump 28 being blocked from communication with the tilt cylinders 20, since the other control valve 36 operatively associated with the tilt cylinders 20 is not actuated. That is, only one of the two pumps is used to extend the tilt cylinders 20 to in turn move the bucket 18 toward a dump position, thus providing a relatively low speed of movement of the bucket 18 from the rack-back position toward the dump position. The rod ends of these cylinders are, of course, relieved of pressure through the conduits 142, 140.

If a relatively higher speed of movement of the bucket 18 from the rack-back position toward the dump position is desired, the valve spool 164 is moved to a third or fast dump position.

With the spool 164 moved to such position, communication of fluid pressure is still provided to the port 178, and the shoulder 280 has been brought against the portion of the body 160, so that the orifice 260 no longer communicates with tank. Pressure supplied through orifice 260 is thereby supplied through orifice 264 to annular chamber 272, and to port 166. Thus, pilot pressure is now supplied to port 166 and port 178 at the same time, so that pilot pressure is supplied to both the end 170 of the control valve 36 and the end 180 of the control valve 44 simultaneously. The control valves 36, 44 are thereby actuated together so that the pumps 28, 40 both supply pressurized fluid to the head ends of the cylinders 20, so that a relatively higher speed of movement of the bucket 18 from the rack-back position towards the dump position thereof is provided. Throughout such dumping, the conduit 76 provides for equal pressurization of the head ends of the cylinders 20, with the rod ends being relieved through conduits 142, 140.

In the condition wherein a heavy load is being dumped in a slow dump state, the bucket 18 has a tendency to be moved to dump faster than the pump is supplying fluid thereto. Because only one spool has been moved, all of the flow from both tilt cylinders must return through the slots in only one control valve, control valve 44. The flow from one of the tilt cylinders is further restricted by having to pass through the relatively small line 78. Thus, good modulation during the slow dump phase is provided.

It will, therefore, be seen that both relatively slow and relatively fast dumping speeds of the bucket 18 are provided, as chosen by the operator, to in turn provide a very high degree of efficiency of use of the apparatus.

DESCRIPTION OF THE PREFERRED EMBODIMENT

Figure 6:
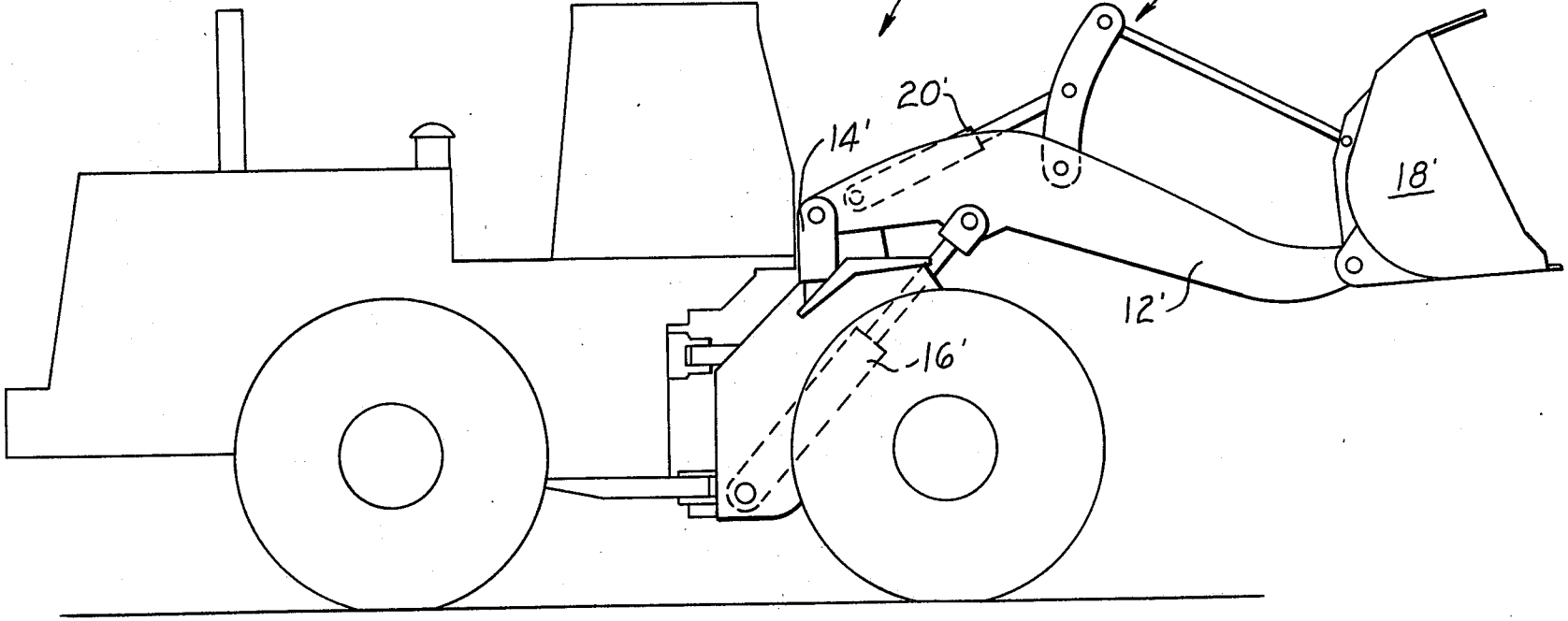
FIG. 6 is a side elevation of a vehicle incorporating the present invention.

Shown in FIG. 6 is a vehicle 10' including lift arms 12' forwardly disposed thereof, pivotally attached to the frame 14' of the vehicle 10', and raisable and lowerable by extension and retraction of lift cylinder 16'. Pivotally secured to the extended ends of the lift arms 12' is a bucket 18' which may be pivoted through link means 22' by extension and retraction of tilt cylinders 20'. It will be seen that retraction of these cylinders 20' moves the bucket 18' to a rack-back position, and extension of the cylinders 20' moves the bucket to a dump position.

The vehicle includes an operator's station 23', with operator controls for selectively actuating the lift and tilt cylinders 16', 20' through actuation of actuator valve means 26' readily accessable to the operator of the vehicle 10'. Only the variations from such apparatus will be described herein in detail.

Figure 7:
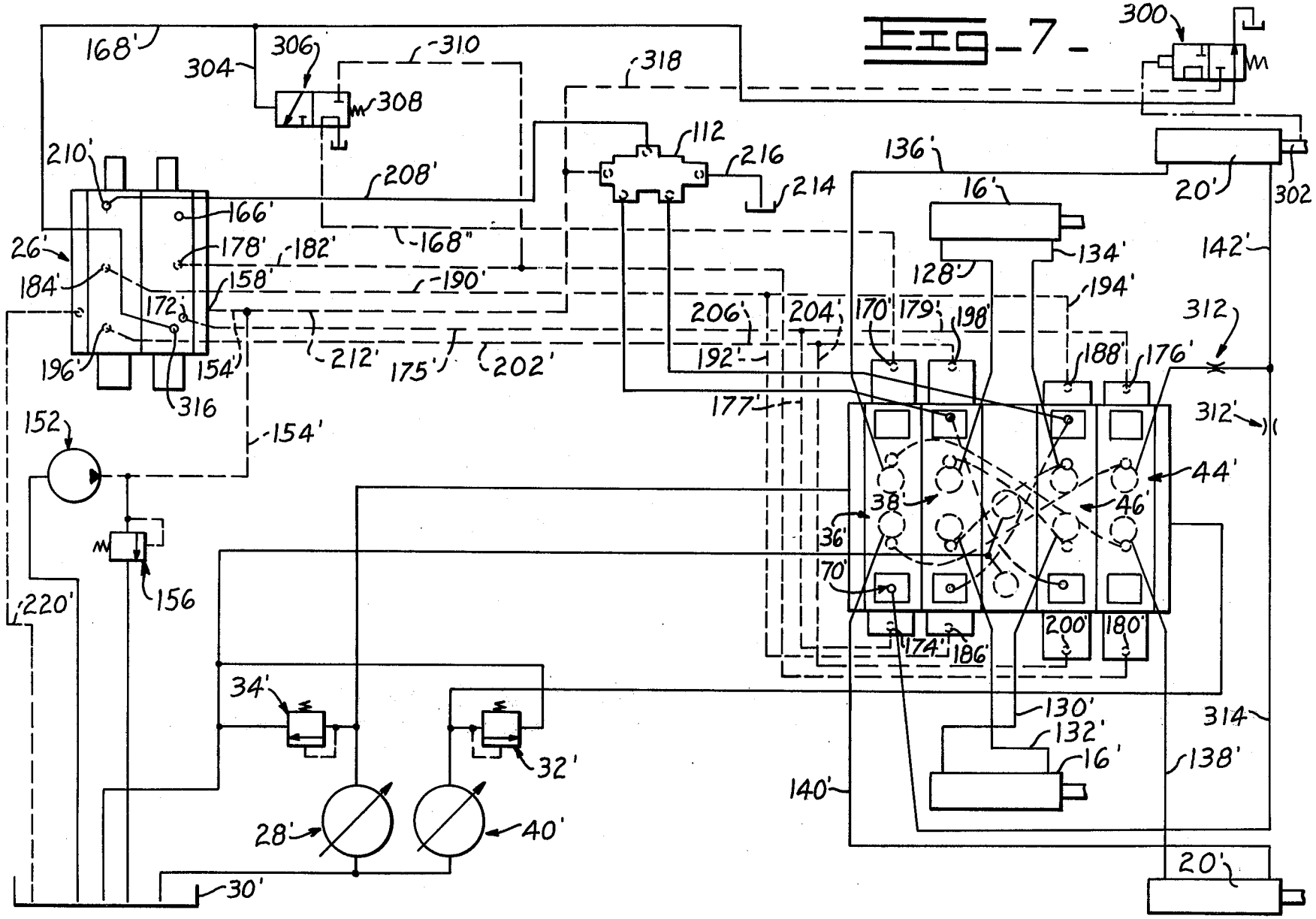
FIG. 7 is a generally schematic representation of a hydraulic control circuit incorporating the invention.

As shown in FIG. 7, the conduit 168' does not communicate with the port 170' as in FIGS. 1 through 5, but rather communicates with a valve 300, movably actuated by the rod 302 of a tilt cylinder 20' so as to be movable thereby upon extension and retraction thereof. A branch conduit 304 communicates with the conduit 168', and is operatively connected with another valve 306. Pressure is supplied to valve 300 by a line 318 communicating with line 212'. A resilient spring 308 biases the valve 306 into a leftward position, and pressure applied in the conduit 168' and branch conduit 304 moves the valve 306 rightwardly against the bias of the spring 308. A branch conduit 310 communicates the conduit 182' and the valve 306 also. The conduit 168" also communicates with the valve 306, rather than the port 166' as in FIGS. 1 through 5. In this application, port 166' is blocked and pressure to port 316 of valve 26' actuates a detent mechanism to prevent detenting 26' in the full dump mode. Such mechanism can be found in U.S. Pat. No. 3,972,264, (assigned to the assignee of this application).

Further included is a restrictor 312 in the conduit 142', and another restrictor 312' and conduit 314 are added, communicating the conduit 142' with the make-up valve 70' of the valve 36'. During the slow dump mode, oil returning from the lower cylinder 20' (as seen in FIG. 7) passes through valve 36', make-up valve 70' and enters line 314, containing restrictor 312', and joins flow from the upper cylinder 20'. Both flows then pass through restrictor 312 and allow that restrictor to be sized to prevent undue pressure buildup on pump 40" during rack-back mode of operation.

In the use of the apparatus, assuming that the bucket 18' is in full rack-back position, i.e., the tilt cylinders 20' are fully retracted, the valves 300, 306 will be in positions opposite that shown in FIG. 7. Actuation of the valve 26' to provide a dump mode provides pressure into conduits 182' and 168' to port 180' and 170' of control valves 36' and 44' until such time as valve 300 is duly actuated. The pressure in conduit 168' moves the valve 306 rightwardly against the spring 308, so that pressure in conduit 168' passes through the valve 306 to conduit 168" to port 170' of control valve 36'. It will be seen that a fast-dump mode is achieved. After a certain amount of the fast-dump movement of the bucket 18', the valve 300 is moved to the leftward position shown wherein fluid pressure in the line 168' is dumped therethrough to tank. This allows the valve 306 to move leftwardly under the resilience of spring 308 as shown, whereupon fluid pressure in the conduit 168" is relieved to tank port through valve 306. Thus, pressure is relieved from the port 170', so that the bucket 18' is automatically shifted into the slow-dump mode after a certain amount of travel thereon in the fast-dump mode from the full rack-back position. Such automatic change is directly related to bucket position because of the interaction of the valve 300 and rod 302 of the tilt cylinder 20'. Thus, after a certain degree of travel of the bucket 18' from the rack-back position, only the slow-dump mode of the bucket 18' can be achieved, for highly efficient operating control of the bucket 18'.

The restrictor aids in allowing fluid flow from the rod end of the cylinder 20' for highly effective control of the bucket 18' with the bucket 18' carrying a very high load.

The slow dumping action of the bucket 18' allows the operator more time to control dumping operation. Also, the bucket velocity is reduced at the appropriate time to reduce shock when the bucket 18' contacts the dump limiting stops. Additionally, the flow of pump 28', cut off from the dump cycles by the valve 36' returning to a neutral condition can be routed to the lift cylinders 16' by actuating the lift control of the valve means 26', adding to the overall utility of the vehicle 10'.

The embodiments of the invention in which an exclusive privilege or property is claimed are defined as follows:

1. In a vehicle having tilt cylinder means actuatable in one and the other directions to move a bucket to a dump position and to a rack-back position respectfully, a hydraulic control system comprising fluid pump means, and means operatively interconnecting the fluid pump means and tilt cylinder means (i) for selectively providing a first, relatively lower speed of movement of the bucket from the rack-back position toward the dump position through actuation of the tilt cylinder means, and for selectively providing a second, relatively higher speed of movement of the bucket from the rack-back position toward the dump position through the actuation of the tilt cylinder means, the means operatively interconnecting the fluid pump means and tilt cylinder means including means for automatically choosing the speed of movement of the bucket such that (ii) upon initial selection of the second, relatively higher speed of movement of the bucket from the rack-back position toward the dump position, and upon a degree of said higher-speed movement taking place, the first, relatively lower speed of movement of the bucket from the rack-back position toward the dump position is automatically chosen.

2. The apparatus of claim 1 wherein the means operatively interconnecting the fluid pump means, and tilt cylinder means comprise bucket position sensing means operatively associated with said tilt cylinder means for sensing the degree of actuation of the tilt cylinder means.

3. The apparatus of claim 2 wherein the fluid pump means includes a first fluid pump and a second fluid pump and wherein the automatic closing means of the means operatively connecting the fluid pump means and tilt cylinder means further comprise valve means operatively connected with said bucket position sensing means and actuatable in response thereto to provide communication between the first fluid pump and tilt cylinder means, and blocking communication between the second fluid pump and tilt cylinder means.

4. The apparatus of claim 3 wherein the means operatively interconnecting the fluid pump means and tilt cylinder means comprise means for selectively providing communication of only the first of the first and second fluid pumps with the tilt cylinder means for providing said first, relatively lower speed of movement of the bucket from the rack-back position toward the dump position, and for selectively providing communication of both the first and second fluid pumps with the tilt cylinder means for providing said second, relatively higher speed of movement of the bucket from the rack-back position toward the dump position thereof.

5. The apparatus of claim 1 wherein the fluid pump means comprise a first fluid pump and a second fluid pump, and wherein the means operatively interconnecting the fluid pump means and tilt cylinder means comprise means for selectively providing communication of only the first of the first and second fluid pumps with the tilt cylinder means for providing said first, relatively lower speed of movement of the bucket, from the rack-back position toward the dump position, and for selectively providing communication of both the first and second fluid pumps with the tilt cylinder means for providing said second, relatively higher speed of movement of the bucket from the rack-back position toward the dump position thereof.

6. The apparatus of claim 1 and further comprising restrictor means operatively associated with the tilt cylinder means, for producing that fluid leaving the tilt cylinder means during actuation thereof in a direction, passes through said restrictor means.

7. The apparatus of claim 6 wherein the restrictor means are operatively associated with the tilt cylinder means to provide that fluid leaving the tilt cylinder means during actuation thereof in the other direction, to move the bucket to a dump position, passes through said restrictor means.

* * * * *